US009041728B2

(12) United States Patent
Wang

(10) Patent No.: US 9,041,728 B2
(45) Date of Patent: May 26, 2015

(54) IMAGE DITHERING MODULE

(75) Inventor: Jian-Chao Wang, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 50 days.

(21) Appl. No.: 13/448,402

(22) Filed: Apr. 17, 2012

(65) Prior Publication Data

US 2013/0141455 A1 Jun. 6, 2013

(30) Foreign Application Priority Data

Dec. 2, 2011 (TW) ..... 100144377 A

(51) Int. Cl.

| | |
|---|---|
| ***G09G 3/20*** | (2006.01) |
| ***G09G 5/02*** | (2006.01) |
| *G09G 3/36* | (2006.01) |

(52) U.S. Cl.

CPC ..... *G09G 3/2048* (2013.01); *G09G 3/3614* (2013.01); *G09G 5/026* (2013.01); *G09G 2320/0242* (2013.01); *G09G 2320/0247* (2013.01); *G09G 2340/10* (2013.01)

(58) Field of Classification Search

CPC . G09G 3/2044; G09G 3/2051; G09G 3/2055; G06T 1/20; G06T 2210/52; H04N 1/4078; H04N 1/6058

See application file for complete search history.

(56) References Cited

U.S. PATENT DOCUMENTS

| | | | | |
|---|---|---|---|---|
| 5,179,641 | A * | 1/1993 | Comins et al. | 345/596 |
| 5,850,208 | A * | 12/1998 | Poole et al. | 345/600 |
| 7,420,571 | B2 * | 9/2008 | Lee et al. | 345/616 |
| 8,243,093 | B2 * | 8/2012 | Feng et al. | 345/597 |
| 2008/0204461 | A1 * | 8/2008 | Hutchins et al. | 345/506 |

FOREIGN PATENT DOCUMENTS

| | | |
|---|---|---|
| TW | 200615858 | 5/2006 |
| TW | 200708122 | 2/2007 |
| TW | 200816120 | 4/2008 |
| TW | 200847124 | 12/2008 |
| TW | 200945244 | 11/2009 |

OTHER PUBLICATIONS

"Office Action of Taiwan Counterpart Application", issued on Dec. 9, 2013, p. 1-p. 8.

* cited by examiner

*Primary Examiner* — Antonio A Caschera
(74) *Attorney, Agent, or Firm* — Jianq Chyun IP Office

(57) ABSTRACT

An image dithering module is provided. The image dithering module includes a plurality of data processing channels. The data processing channels respectively process image data of each pixel or sub-pixel in an image frame. Each of the data processing channels includes a bit processing unit and a bit truncator unit. The bit processing unit mixes first pixel data with random data to generate second pixel data. The bit truncator unit truncates partial bits of the second pixel data to generate third pixel data.

10 Claims, 4 Drawing Sheets

IMAGE DITHERING MODULE

CROSS-REFERENCE TO RELATED APPLICATION

This application claims the priority benefit of Taiwan application serial no. 100144377, filed on Dec. 2, 2011. The entirety of the above-mentioned patent application is hereby incorporated by reference herein and made a part of this specification.

BACKGROUND OF THE INVENTION

1. Field of the Invention

The invention relates to an image processing module. Particularly, the invention relates to an image dithering module suitable for image processing.

2. Description of Related Art

Generally, due to characteristics of liquid crystal molecules, when the liquid crystal is driven, a display driving device generally uses a frame inversion technique to drive pixels on a display panel through voltages of positive and negative polarities, so that polarities of the liquid crystal molecules are frequently inverted. However, since the voltages of different polarities may have some offsets, tilt angles of the liquid crystal molecules are different, and a color shift phenomenon is occurred between pixels. Therefore, when a plurality of frames is sequentially displayed, the pixels of each frame are all driven by a voltage of the positive polarity or the negative polarity, and are alternately displayed, and now the image frame may have a flicker phenomenon. In order to mitigate the flicker phenomenon of the image frames, the conventional technique develops a line inversion mode and a dot inversion mode to drive the liquid crystal display (LCD) panel. In this way, the color viewed by human eyes is an average of the pixels of the positive polarity and the negative polarity, and the flicker phenomenon is not occurred when the frames are switched.

On the other hand, considering the cost, a bit number of a driving device of the LCD panel is probably smaller than a grayscale depth required to be performed by the image frame. Now, in order to reconstruct the grayscales, a frame rate control (FRC) technique is generally used to implement modulation of a time axis, or an approach of a spatial domain grayscale average is used for implementation. When the FRC technique is used, a cycle pattern capable of being regularly appeared on the time axis is required to be found, so that values of a part of the pixels are interpolated grayscale values. Moreover, during the interpolation, polarity driving relationship of the pixels is required to be noticed, so as to avoid abnormal phenomenon of the image frame such as rolling lines or the flicker phenomenon, etc. Moreover, when the approach of the spatial domain grayscale average is used to implement the FRC technique, if a fixed interpolation pattern is used, abnormity of the image frames is easy to be perceived by eyes.

SUMMARY OF THE INVENTION

An image dithering module is disclosed, which can avoid frame abnormity generated under a frame rate control (FRC) technique.

An embodiment of the invention provides an image dithering module. The image dithering module includes a plurality of data processing channels. The data processing channels respectively process image data of each pixel or sub-pixel in an image frame. Each of the data processing channels includes a bit processing unit and a bit truncator unit. The bit processing unit mixes first pixel data with random data to generate second pixel data. The bit truncator unit truncates partial bits of the second pixel data to generate third pixel data.

In an embodiment of the invention, the bit processing unit adds the first pixel data with the random data to generate the second pixel data.

In an embodiment of the invention, the random data is added to a least significant bit of the first pixel data.

In an embodiment of the invention, a random value of the random data is within a specific range, and the specific range is determined according to a number of bits of the first pixel data.

In an embodiment of the invention, the bit truncator unit outputs partial bits of the second pixel data to serve as the third pixel data, and a number of bits of the third pixel data is less than a number of bits of the second pixel data.

In an embodiment of the invention, the bit truncator unit replaces values of the partial bits of the second pixel data with zero to generate the third pixel data.

In an embodiment of the invention, the partial bits of the second pixel data are least significant bits of the second pixel data.

In an embodiment of the invention, the image dithering module further includes at least one random generator unit. Each of the random generator units provides the random data to the bit processing unit of at least one of the data processing channels.

In an embodiment of the invention, a number of the random generator units is equal to a number of the data processing channels, and each of the data processing channels exclusively corresponds to at least one of the random generator units.

In an embodiment of the invention, the number of the random generator units is less than the number of the data processing channels, and at least two of the channel processing channels share a same random generator unit.

In an embodiment of the invention, the image dithering module further includes at least one multiplexer. The multiplexer selects one of random data generated by at least two of the random generator units for providing to one of the data processing channels for utilization.

In an embodiment of the invention, the bit processing unit mixes the first pixel data with compensation data to generate the second pixel data. A value of the compensation data is determined according to a position of the first pixel data in the image frame.

In an embodiment of the invention, the image dithering module further includes a pattern generator unit. The pattern generator unit generates a pattern of the image frame. The pattern represents a compensation bit of each pixel or sub-pixel in the image frame.

In an embodiment of the invention, the image dithering module further includes at least one compensation determination unit. The compensation determination unit determines whether the bit processing unit mixes the compensation data.

In an embodiment of the invention, the pattern is a random pattern or a fixed pattern.

According to the above descriptions, the image dithering module can mix the random data with the image frame having more number of bits, and truncates the number of bits on the image frame after being mixed to generate pixel data. By this way, an image frame having a relatively high grayscale depth can be implemented by utilizing the pixel data with lower number of bits.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
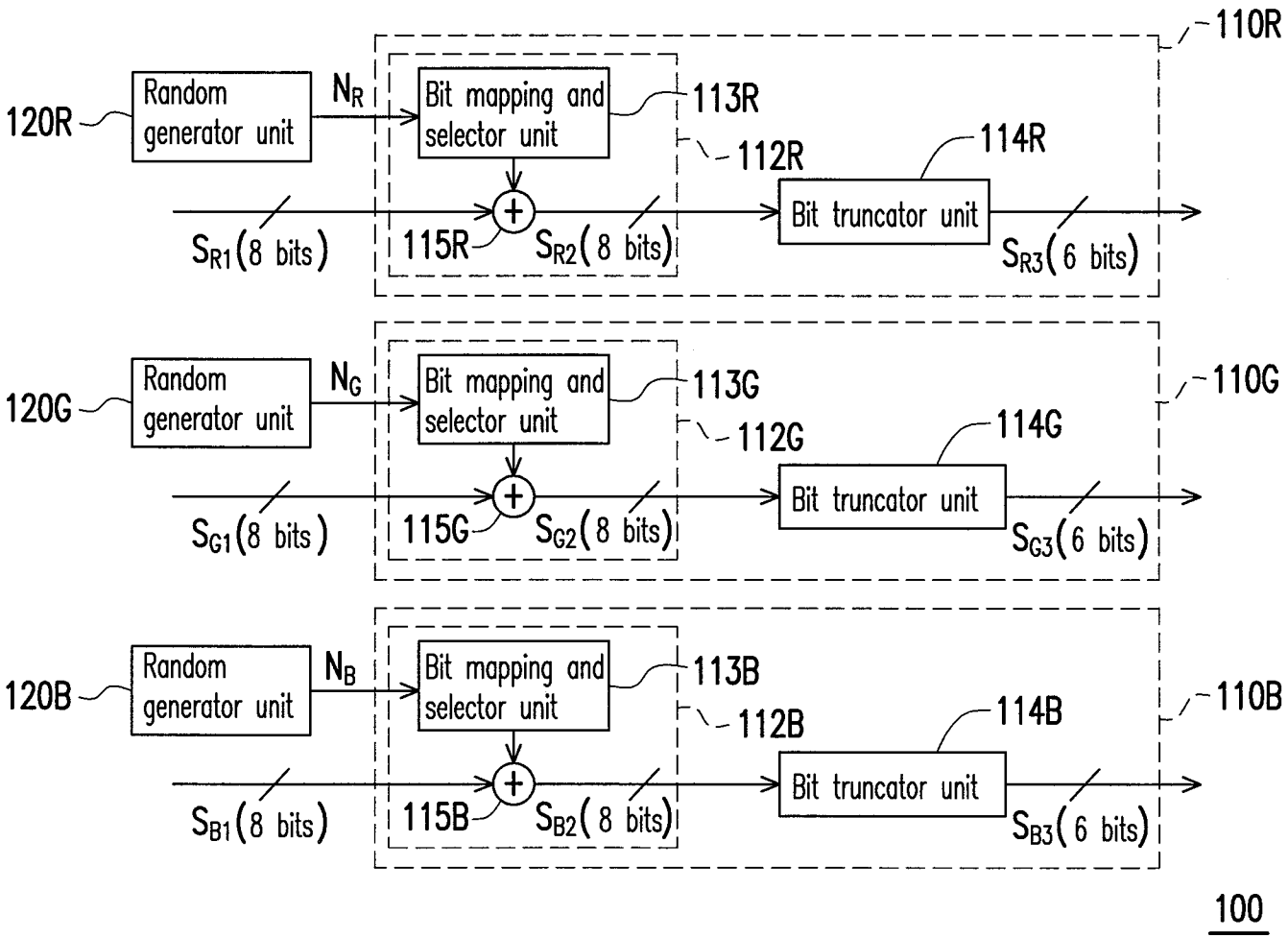
FIG. 1 is a block schematic diagram of an image dithering module according to an embodiment of the invention.

FIG. 1 is a block schematic diagram of an image dithering module according to an embodiment of the invention. Referring to FIG. 1, the image dithering module 100 of the present embodiment is adapted to perform a dithering algorithm processing, which is a kind of image processing procedure. The image dithering module can be implemented in the front-end of or within a timing controller of display device, within a source driver, or in the back-end of following an image scaler. The location that the image dithering module being configured in the image display device is not limited in the invention.

In the present embodiment, the image dithering module 100 includes three data processing channels 110R, 110G and 110B and three random generator units 120R, 120G and 120B. In an image frame, for red, green and blue sub-pixels are processed by the data processing channels 110R, 110G and 110B, respectively. Random data are provided to the data processing channels 110R, 110G and 110B by the random generator units 120R, 120G and 120B, respectively.

In other words, the number of the random generator units 120R, 120G and 120B is equal to the number of the data processing channels 110R, 110G and 110B, so that each of the data processing channels exclusively corresponds one random generator unit. Namely, the image dithering module 100 processes image data based on sub-pixels, so as to reduce correlation between the sub-pixels, which has at least one advantage that pixel particles in the image frame perceived by human eyes become finer. However, the invention is not limited thereto. For example, in other embodiments, the image dithering module 100 can also process image data based on pixels, i.e. the three data processing channels 110R, 110G and 110B share a same random generator unit.

In detail, taking the data processing channel 110R as an example, it is used to process image data SR1 for a red pixel in the image frame and receive random data NR provided by the random generator unit 120R. In the present embodiment, the data processing channel 110R includes a bit processing unit 112R and a bit truncator unit 114R.

The bit processing unit 112R mixes the first pixel data $S_{R1}$ with the random data $N_R$ to generate second pixel data $S_{R2}$. Then, the bit truncator unit 114R truncates partial bits of the second pixel data $S_{R2}$ to generate third pixel data $S_{R3}$ after obtaining the second pixel data $S_{R2}$. Detailed structure and operation flow of the bit processing unit 112R and the bit truncator unit 114R are described below.

In FIG. 1, a detailed structure of the bit processing unit 112R is illustrated. As shown in FIG. 1, the bit processing unit 112R includes a bit mapping and selector unit 113R and an adder unit 115R. The bit mapping and selector unit 113R receives the random data $N_R$, and selects partial or all bits of the random data $N_R$, and then maps the partial or all bits to a random value in a specific range. Then, the adder unit 115R adds the mapped random value to the first pixel data $S_{R1}$, for example, adds the mapped random value to a least significant bit of the first pixel data $S_{R1}$ to generate the second pixel data $S_{R2}$. Namely, in the present embodiment, when the bit processing unit 112R performs the mixing step, the bit processing unit 112R uses the adder unit 115R to add the first pixel data $S_{R1}$ with the random data $N_R$ to generate the second pixel data $S_{R2}$.

For example, as shown in a following table, the bit mapping and selector unit 113R, for example, selects two least significant bits in the random data $N_R$. Bit combinations of the two least significant bits include 00, 01, 10 and 11, and the specific range is, for example, random values from −2 to +1, wherein the bit combinations 00, 01, 10 and 11 respectively correspond to the random values +0, +1, −2 and −1, for example.

| Least significant bit (LSB) | Random value |
|---|---|
| 00 | +0 |
| 01 | +1 |
| 10 | −2 |
| 11 | −1 |

Therefore, when the bit mapping and selector unit 113R selects the bit combination 00 from the random data $N_R$, the bit mapping and selector unit 113R maps the bit combination 00 to the random value +0, and then the bit processing unit 112R uses the adder unit 115R to add the random value +0 to the least significant bit of the first pixel data $S_{R1}$, so as to generate the second pixel data $S_{R2}$. Deduced by analogy, when the selected bit combination is 01, 10 or 11, similar method can be used to obtain the corresponding second pixel data $S_{R2}$.

It should be noted that the aforementioned mapping relationship, the specific range of the random values, the number of the selected bits of the random data, and the manner to mix the random value and the first pixel data, are not limited by the invention, and the disclosure of the present embodiment is only used as an example. In other embodiments, the mapped random values can be random integers between a specific range of −1 and +1, and any two of the bit combinations probably correspond to a same random integer in the specific range of −1 to +1. Moreover, the selected bits of the random data can be three least significant bits, and the mapped random value can be a random integer between a specific range of −4 and +3, or −3 and +3, for example.

On the other hand, the number of the selected bits of the random data can be adjusted according to an actual design requirement. For example, the number of bits being selected in the random data can be increased with the number of bits of the first pixel data, so as to increase diversity of the random data. Therefore, the random values represented by the random data are within a specific range, which can be determined by the number of bits of the first pixel data.

On the other hand, after the second pixel data $S_{R2}$ is obtained, the bit truncator unit 114R truncates partial bits in the second pixel data $S_{R2}$ to generate the third pixel data $S_{R3}$. Various truncating method can be used. In an embodiment, the bit truncator unit 114R truncates the least significant bits of the second pixel data $S_{R2}$ to directly output the third pixel data $S_{R3}$ with fewer bits. For example, the second pixel data $S_{R2}$, for example, has 8 bits, and the bit truncator unit 114R converts it into the third pixel data $S_{R3}$ with 6 bits. Alternatively, in another embodiment, the bit truncator unit 114R can also replace values of the partial bits, for example, the least significant bits of the second pixel data with zero to generate the third pixel data $S_{R3}$.

The dithering algorithm of the present embodiment can be used to provide an 8 to 6-bit dithering function for a 6-bit source driver used for controlling the thin-film transistors of the liquid crystal panel. The dithering function can use a concept of average to enable human eyes to perceive a resolution of 4 times, i.e. a memory amount of 6-bit 64-color can be used to imitate a 8-bit 256-color display effect. Moreover, in the present embodiment, although the dithering operation of converting 8 bits to 6 bits is taken as an example for descriptions, conversion of other number of bits, for example, a conversion from 10 bits to 8 bits, a conversion from 8 bits to 6 bits and a conversion from 6 bits to 4 bits can also be performed to implement the dithering operation.

As described above, the data processing channel 110R is used to process image data of the red sub-pixel in the image frame. The bit processing unit 112R adds the random data $N_R$ to the least significant bit of the first pixel data $S_{R1}$ to generate the second pixel data $S_{R2}$. The bit truncator unit 114R truncates the least significant bit of the second pixel data $S_{R2}$ to generate the third pixel data $S_{R3}$. Similarly, the data processing channel 110G is used to process image data of the green sub-pixel in the image frame. A bit processing unit 112G adds random data $N_G$ to a least significant bit of first pixel data $S_{G1}$ to generate second pixel data $S_{G2}$. A bit truncator unit 114G truncates a least significant bit of the second pixel data $S_{G2}$ to generate third pixel data $S_{G3}$. The data processing channel 110B is used to process image data of the blue sub-pixel in the image frame. A bit processing unit 112B adds random data $N_B$ to a least significant bit of first pixel data $S_{B1}$ to generate second pixel data $S_{B2}$. A bit truncator unit 114B truncates a least significant bit of the second pixel data $S_{B2}$ to generate third pixel data $S_{B3}$. Moreover, regarding structures and operation details of the data processing channels 110G and 110B, those skilled in the art can learn enough instructions and recommendations from related descriptions of the data processing channel 110R, so that detailed descriptions thereof are not repeated.

Figure 2:
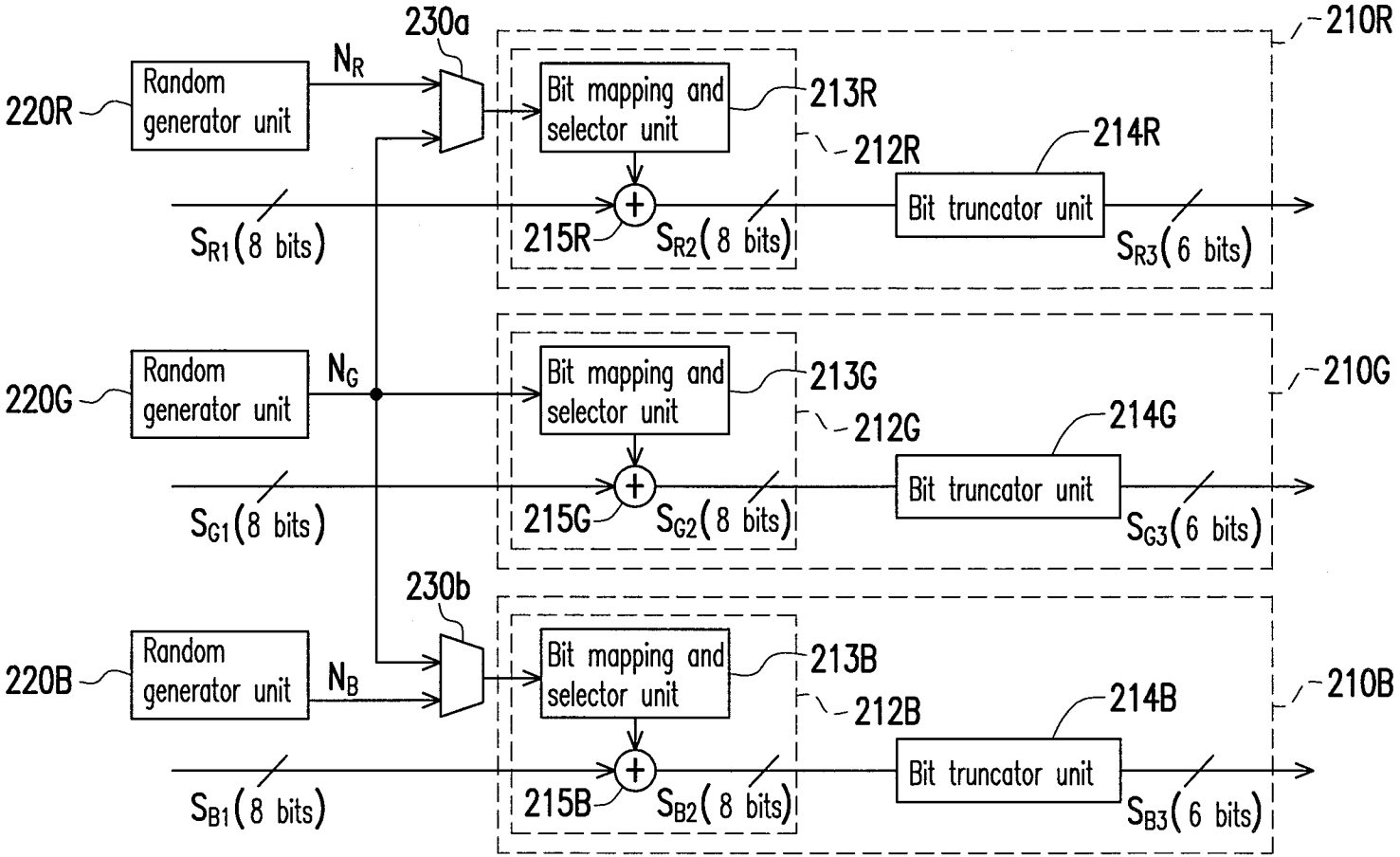
FIG. 2 is a block schematic diagram of an image dithering module according to another embodiment of the invention.

FIG. 2 is a block schematic diagram of an image dithering module according to another embodiment of the invention. Referring to FIG. 1 and FIG. 2, the image dithering module 200 of the present embodiment is similar to the image dithering module 100 of FIG. 1, and a main difference there between is that the image dithering module 200 further includes two multiplexers 230*a* and 230*b*. Each of the multiplexers is used to select one of random data generated by at least two of the random generator units (two of the random generator units are taken as an example) for providing to one of the data processing channels for utilization.

In detail, the multiplexer 230*a* selects one of the random data $N_R$ and $N_G$ respectively generated by the random generator units 220R and 220G, in order for the data processing channel 210R to utilize. The multiplexer 230*b* selects one of the random data $N_G$ and $N_B$ respectively generated by the random generator units 220G and 220B, in order for the data processing channel 210B to utilize. Namely, at least two of the data processing channels of the present embodiment selectively share a same random generator unit. It should be noticed that the image dithering module 200 may also include at least one multiplexer to achieve the effect that the data processing channels share the random data. Therefore, the number of the multiplexers of the present embodiment is not limited to two.

Moreover, it should be noted that in other embodiments, when the number of the random generator units is less than the number of the number of the data processing channels, at least two of the channel processing channels can share a same random generator unit, and one or more multiplexers can be used according to an actual need. For example, the image dithering module 200 may only include a single random generator unit, and the channel processing channels 210R, 210G and 210B can share the same random data. Now, the multiplexers are not configured in the image dithering module 200. In brief, the number of the random generator units can be equal to or less than the number of the data processing channels, or one to a plurality of multiplexers can be used such that at least two of the data processing channels share a same random generator unit.

Figure 3:
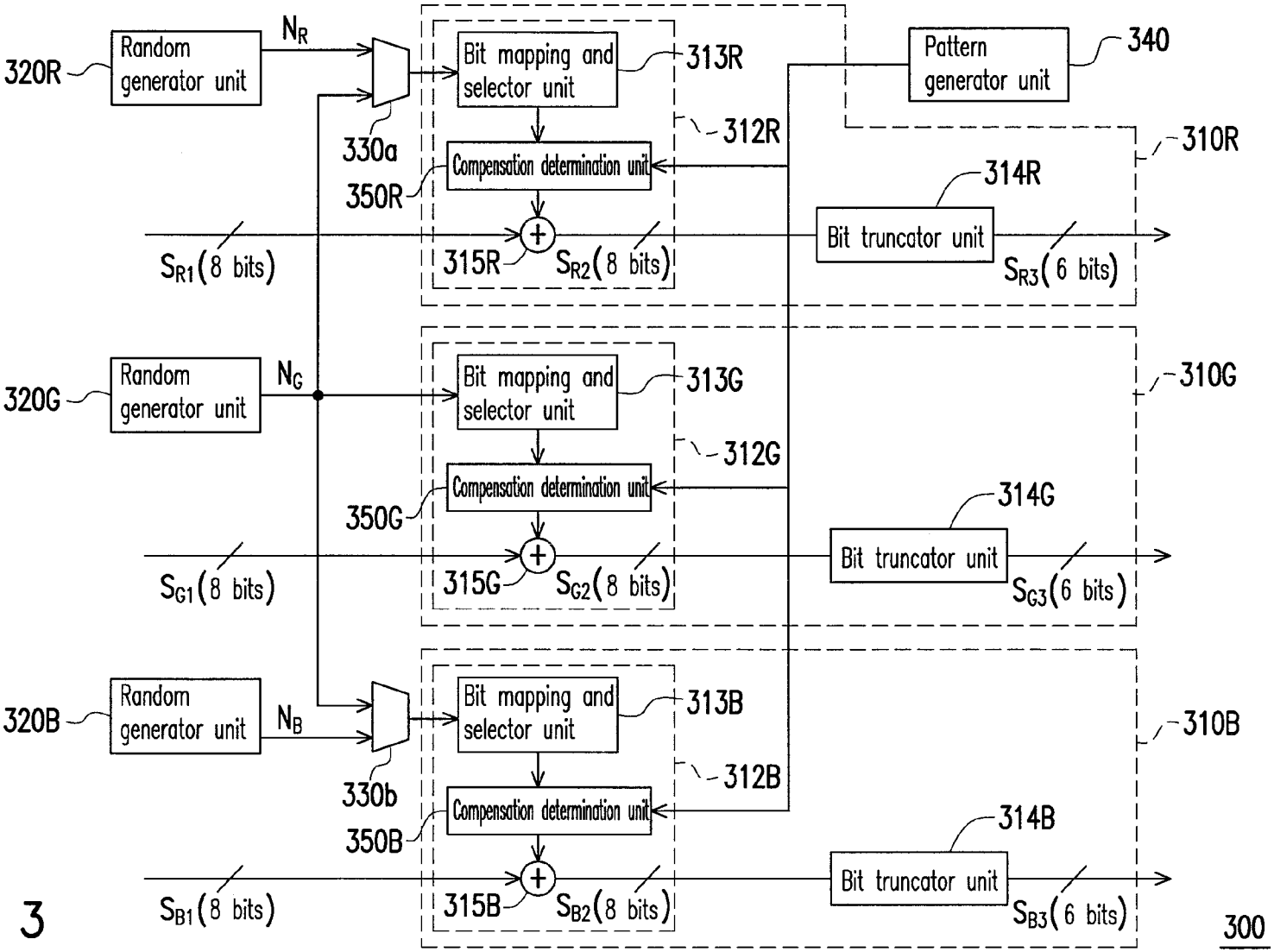
FIG. 3 is a block schematic diagram of an image dithering module according to another embodiment of the invention.

FIG. 3 is a block schematic diagram of an image dithering module according to another embodiment of the invention. Referring to FIG. 2 and FIG. 3, the image dithering module 300 of the present embodiment is similar to the image dithering module 200 of FIG. 2, and a main difference there between is that the image dithering module 300 further includes a pattern generator unit 340 and three compensation determination units 350R, 350G and 350B. In the present embodiment, bit processing units 312R, 312G and 312B respectively mix the first pixel data $S_{R1}$, $S_{G1}$ and $S_{B1}$ with compensation data to generate second pixel data $S_{R2}$, $S_{G2}$ and $S_{B2}$, where a value of the compensation data can be determined according to positions of the first pixel data $S_{R1}$, $S_{G1}$ and $S_{B1}$ in the image frame.

In detail, the pattern generator unit 340 generates a pattern of the image frame. The pattern is a random pattern or a fixed pattern, which represents a compensation bit of each pixel or sub-pixel in the image frame. The compensation determination units 350R, 350G and 350B are respectively disposed between bit mapping and selector units 313R, 313G and 313B and adder units 315R, 315G and 315B of the data processing channels 310R, 310G and 310B, as that shown in FIG. 3. The compensation determination units 350R, 350G and 350B can respectively determine whether the bit processing unit 312R, 312G and 312B mix the compensation data according to a compensation bit, which can be represented by a position of the currently processed pixel or sub-pixel in the pattern.

Figure 4:
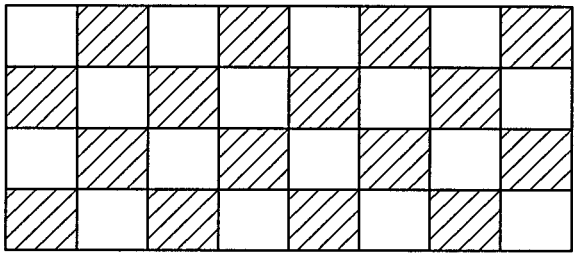
FIG. 4 is a schematic diagram of a pattern generated by a pattern generator unit of FIG. 3.

FIG. 4 is a schematic diagram of a pattern generated by the pattern generator unit of FIG. 3. Referring to FIG. 4, the pattern generated by the pattern generator unit 340 of the present embodiment is, for example, a fixed pattern, which presents the compensation bit of each of the sub-pixels in the image frame. The black color represents that the compensation is required, as indicated by compensation bit "1," for example. On the other hand, the white color represents that the compensation is not required, i.e. the compensation bit is 0. Taking the data processing channel 310R as an example, after the determination of the compensation determination unit 350R, if it is determined to compensate the first pixel data $S_{R1}$ of the sub-pixel, besides adding the mapped random value to the least significant bit of the first pixel data $S_{R1}$, the adder unit 315R further adds the compensation bit represented by the sub-pixel shown in the fixed pattern of FIG. 4 to the first pixel data $S_{R1}$, so as to generate the second pixel data $S_{R2}$.

Now, a magnitude of the random value mixed in the second pixel data $S_{R2}$ is changed due to the compensation bit, so that pixel particles in the image frame perceived by human eyes become finer, and an influence of the mixed random value on the image frame perceived by human eyes can be reduced.

In another embodiment, the pattern generated by the pattern generator unit 340 is, for example, a random pattern. Besides the advantages of mixing the fixed pattern to the first pixel data $S_{R1}$, the random pattern can further increase variation diversity of the mixed random values.

Figure 5:
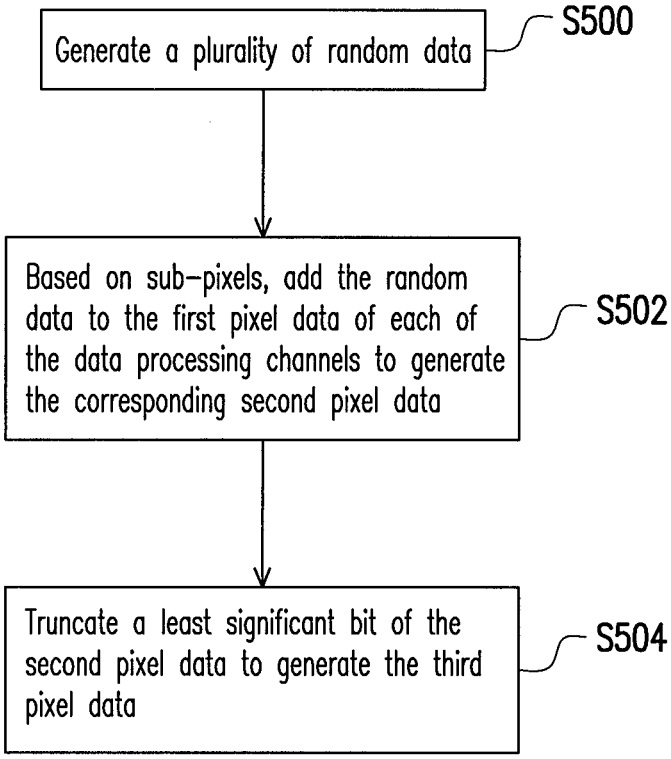
FIG. 5 is a flowchart illustrating a dithering algorithm method according to an embodiment of the invention.

FIG. 5 is a flowchart illustrating a dithering algorithm method according to an embodiment of the invention. Referring to FIG. 1 and FIG. 5, the dithering algorithm method of the present embodiment is, for example, executed on the image dithering module 100 of FIG. 1, which includes following steps. First, in step S500, a plurality of random data is generated. In step S502, based on the sub-pixels, the random data is added to the first pixel data of each of the data processing channels to generate the corresponding second pixel data. It should be noted that as described above, such a step can be implemented based on pixels. In step S504, the least significant bit of the second pixel data is truncated to generate the third pixel data. Moreover, regarding details of the steps of the dithering algorithm method of the present embodiment, those skilled in the art can learn enough instructions and recommendations from related descriptions of the embodiments of FIG. 1-FIG. 4, so that detailed descriptions thereof are not repeated.

In summary, the image dithering module mixes the random data with the image frame having more number of bits, and truncates the number of bits on the image frame after being mixed to generate pixel data. By this way, an image frame having a relatively high grayscale depth can be implemented by utilizing the pixel data with lower number of bits. By mixing the random data, frame abnormity generated under the frame rate control technique can be avoided. Moreover, according to the method, the strength of the random data can be controlled with an usage of a random or fixed pattern, so that pixel particles in the image frame perceived by human eyes are finer.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An image display device for performing a dithering algorithm process, the image display device comprising:

a bit processing circuit mixing first pixel data with random data and compensation data to generate second pixel data, wherein a value of the compensation data is determined according to a position of the first pixel data in the image frame;

a bit truncator circuit truncating partial bits of the second pixel data to generate third pixel data;

at least one random generator unit, each providing the random data to the bit processing circuit;

a pattern generator unit generating a pattern of the image frame, wherein the pattern represents a compensation bit of each pixel or sub-pixel in the image frame, and wherein the bit processing circuit comprises:

a bit mapping and selector unit receiving the random data and accordingly generating a random value;

a compensation determination unit coupled to the bit mapping and selector unit and the pattern generator unit, receiving the random value and determining whether to output the compensation data according to the compensation bit;

an adder unit coupled to the compensation determination, mixing the compensation data to the first pixel data and generating the second pixel data, wherein if the compensation bit is 0, the compensation determination unit does not output the random value as the compensation data, and if the compensation bit is 1, the compensation determination unit outputs the random value as the compensation data to the adder unit.

2. The image display device for performing the dithering algorithm process as claimed in claim 1, wherein the random value of the random data is within a specific range, and the specific range is determined according to a number of bits of the first pixel data.

3. The image display device for performing the dithering algorithm process as claimed in claim 1, wherein the bit truncator circuit outputs partial bits of the second pixel data to serve as the third pixel data, and a number of bits of the third pixel data is less than a number of bits of the second pixel data.

4. The image display device for performing the dithering algorithm process as claimed in claim 1, wherein the bit truncator circuit replaces values of the partial bits of the second pixel data with zero to generate the third pixel data.

5. The image display device for performing the dithering algorithm process as claimed in claim 4, wherein the partial bits of the second pixel data are least significant bits of the second pixel data.

6. The image display device for performing the dithering algorithm process as claimed in claim 1, wherein a number of the at least one random generator unit is equal to a number of data processing channels, and each of the data processing channels exclusively corresponds to one of the at least one random generator unit.

7. The image display device for performing the dithering algorithm process as claimed in claim 1, wherein the number of the at least one random generator unit is less than the number of data processing channels, and at least two of the channel processing channels share a same random generator unit.

8. The image display device for performing the dithering algorithm process as claimed in claim 1, wherein the at least one random generator unit refers to a plurality of random generator units, and the image dithering apparatus further comprises at least one multiplexer selecting one of random data generated by at least two of the random generator units for providing to one of the data processing channels for utilization.

9. The image display device for performing the dithering algorithm process as claimed in claim 1, wherein the pattern is a random pattern.

10. The image display device for performing the dithering algorithm process as claimed in claim 1, wherein the pattern is a fixed pattern.

* * * * *